US008950957B2

(12) United States Patent
Supron et al.

(10) Patent No.: US 8,950,957 B2
(45) Date of Patent: Feb. 10, 2015

(54) CONFIGURABLE PRINTER FOR DIFFERENT PAPER SIZES AND METHODS FOR CONFIGURING A PRINTER FOR DIFFERENT PAPER SIZES

(75) Inventors: Steven A. Supron, Ithaca, NY (US); Robert F. Bullivant, Interlaken, NY (US); Bruce Harris, Freeville, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 173 days.

(21) Appl. No.: 13/419,502

(22) Filed: Mar. 14, 2012

(65) Prior Publication Data

US 2013/0243510 A1 Sep. 19, 2013

(51) Int. Cl.

| | |
|---|---|
| ***B41J 11/00*** | (2006.01) |
| ***B41J 15/00*** | (2006.01) |
| ***B41J 15/04*** | (2006.01) |

(52) U.S. Cl.

CPC ..... *B41J 11/0025* (2013.01); *B41J 15/042* (2013.01); *B41J 11/008* (2013.01)

USPC ..... 400/583; 400/613; 242/595

(58) Field of Classification Search

CPC ..... B41J 11/0025; B41J 11/003; B41J 11/00; B41J 15/042; B65H 2511/12; B65H 16/02; B65H 16/08; B65H 2405/40

USPC ..... 400/583, 613; 242/595

See application file for complete search history.

(56) References Cited

U.S. PATENT DOCUMENTS

| | | | | |
|---|---|---|---|---|
| 2,170,147 | A | | 8/1939 | Lane |
| 3,447,409 | A | | 6/1969 | Lewis |
| 4,448,101 | A | | 5/1984 | Templeton |
| 4,979,838 | A | | 12/1990 | Yokota et al. |
| 4,981,059 | A | | 1/1991 | Kobayashi |
| 5,174,824 | A | | 12/1992 | Salancy et al. |
| 5,243,890 | A | | 9/1993 | Ober |
| 5,531,530 | A | * | 7/1996 | Kuramoto et al. ..... 400/593 |
| 5,690,437 | A | * | 11/1997 | Yanagisawa et al. .... 400/120.14 |
| 6,609,844 | B1 | * | 8/2003 | Petteruti et al. ..... 400/88 |
| 7,588,811 | B2 | | 9/2009 | Blank et al. |
| 2007/0110493 | A1 | * | 5/2007 | Chen ..... 400/691 |

(Continued)

FOREIGN PATENT DOCUMENTS

| | | | | |
|---|---|---|---|---|
| JP | 60161851 | * | 8/1985 | ..... B65H 16/02 |
| JP | 05278906 | * | 10/1993 | ..... B65H 16/02 |

OTHER PUBLICATIONS

Pitney Bowes Brochure, Accelerated processing, Digital Mailing System with IntelliLink® Technology DM400™ Series, 4 pages, 2008.

*Primary Examiner* — Blake A Tankersley

(74) *Attorney, Agent, or Firm* — Lipsitz & McAllister, LLC

(57) ABSTRACT

In accordance with one example embodiment of a configurable printer for different paper sizes and types in accordance with the present invention, the configurable printer may comprise a print mechanism, a controller for controlling the print mechanism, a paper bucket for receiving a first sized paper roll to be printed, a divider for a paper bucket for reducing a width of the paper bucket to accept a second sized paper roll which is smaller than the first sized paper roll, and a bucket sensor adapted to sense at least one of insertion of the divider into the paper bucket and removal of the divider from the paper bucket and to provide a paper size signal to the controller. The controller controls the print mechanism in response to the paper size signal from the bucket sensor.

23 Claims, 12 Drawing Sheets

(56) References Cited

U.S. PATENT DOCUMENTS

2007/0231043 A1* 10/2007 Miyashita et al. ..... 400/615.2
2007/0262141 A1* 11/2007 Ito et al. ..... 235/383
2010/0139467 A1 6/2010 Gutknecht et al.

* cited by examiner

CONFIGURABLE PRINTER FOR DIFFERENT PAPER SIZES AND METHODS FOR CONFIGURING A PRINTER FOR DIFFERENT PAPER SIZES

BACKGROUND OF THE INVENTION

The present invention relates to the field of label and receipt printers. More specifically, the present invention relates to a printer that is configurable for different paper sizes and corresponding methods.

Printers that print from paper rolls are widely used in various locations, including at the point of sale in retail establishments, in kiosk such as ATM and ticket machines, lottery machines, and anywhere the printing of labels is required, such as in the food preparation area of fast food restaurants or the like. Such printers include label printers, ticket printers, receipt printers, and the like (collectively referred to herein as "label and receipt printers").

However, typical label and receipt printers are configured to accept a single size of paper roll. With such printers, there is no need to program or configure a cutter mechanism or a print mechanism for different paper widths or for different types of paper (e.g., plain paper, sticky label paper, etc.).

For certain applications or customer locations, it is desirable to have separate printers for both receipts and/or labels which use paper rolls of different widths or different paper types. To avoid the need to have two separate printers for accommodating paper rolls of different widths and types, the Assignee of the present invention, TransAct Technologies Inc., is developing a printer that can be configured to accept paper rolls of different widths and to print on paper rolls of different types.

Accordingly, it would be advantageous for such a printer to be automatically configured for accepting, printing on and cutting paper rolls of different widths and different types. It would also be advantageous to enable automatic configuration of a print energy, print speed, and print scale based on the size or type of paper present in the printer.

The methods and apparatus of the present invention provide the foregoing and other advantages.

SUMMARY OF THE INVENTION

The present invention relates to a printer that is configurable for different paper sizes and corresponding methods for configuring a printer.

In accordance with one example embodiment of a configurable printer for different paper sizes and types in accordance with the present invention, the configurable printer may comprise a print mechanism, a controller for controlling the print mechanism, a paper bucket for receiving a first sized paper roll to be printed, a divider for the paper bucket for reducing a width of the paper bucket to accept a second sized paper roll which is smaller than the first sized paper roll, and a bucket sensor adapted to sense at least one of insertion of the divider into the paper bucket and removal of the divider from the paper bucket and to provide a paper size signal to the controller. The controller controls the print mechanism in response to the paper size signal from the bucket sensor.

The controller may reduce at least one of a print area and a speed of the print mechanism in accordance with the paper size signal when the bucket sensor senses the insertion of the divider into the paper bucket. The controller may increase at least one of a print area and a speed of the print mechanism in accordance with the paper size signal when the bucket sensor senses the removal of the divider from the paper bucket.

The configurable printer may further comprise a cutter mechanism for cutting the paper roll. The controller may control a length of travel of the cutter mechanism in response to the paper size signal from the bucket sensor. For example, the controller may reduce the length of travel of the cutter mechanism in accordance with the paper size signal when the bucket sensor senses the insertion of the divider into the paper bucket. The controller may increase the length of travel of the cutter mechanism in accordance with the paper size signal when the bucket sensor senses the removal of the divider from the paper bucket.

The controller may reduce a scale of text to be printed in accordance with the paper size signal when the bucket sensor senses the insertion of the divider into the paper bucket. The controller may increase a scale of text to be printed in accordance with the paper size signal when the bucket sensor senses the removal of the divider from the paper bucket.

The first sized paper roll may be, for example 80 mm wide. The second sized paper roll may be, for example, 40 mm wide. However, those skilled in the art will appreciate that the paper bucket and divider may be configured to accept various sizes of paper rolls. It is also conceivable that the configurable printer can be designed to accept three different sized paper rolls, e.g., by providing two separate areas for insertion of the divider.

Label printers may use a paper roll with glue or other adhesive on one side for printing sticky labels rather than plain thermal paper rolls. Such rolls containing adhesive may include evenly spaced-apart black dots or lines denoting print areas for the sticky labels. To accommodate the use of sticky label paper rolls, the configurable printer may further comprise a paper sensor for sensing a presence of black marks (e.g., lines or dots) on the paper roll and providing a paper type signal to the controller. The controller, in response to the paper type signal indicating the presence of black marks, may at least one of decreases a print speed of the print mechanism and increases an energy of the print mechanism to better print on the sticky paper roll. For example, the second sized (smaller) paper roll may be an adhesive backed paper roll, and the black marks may denote a location of adhesive, which is positioned between the black marks.

The bucket sensor may comprise an optical sensor residing on a controller board of the printer. A flag may be provided for triggering the bucket sensor upon insertion of the divider into the paper bucket and contacting the flag. One or more protrusions on the divider may depress the flag to trigger the bucket sensor to indicate the insertion of the divider into the paper bucket. At least one of the one or more protrusions may serve to fix the divider in the paper bucket.

In an example embodiment of a method for configuring a printer for different paper sizes and types in accordance with the present invention, the method may comprise: providing a divider for a paper bucket for reducing a width of the paper bucket; sensing at least one of insertion of the divider into the paper bucket and removal of the divider from the paper bucket via a bucket sensor; and providing a paper size signal for use in controlling a print mechanism in response to the paper size signal. The paper bucket is adapted for receiving a first sized paper roll without the divider and to receive a second sized paper roll with the divider, the second sized paper roll being smaller than the first sized paper roll.

The method may also include additional features discussed above in connection with the various embodiments of the corresponding configurable cutter mechanism.

BRIEF DESCRIPTION OF THE DRAWINGS

The present invention will hereinafter be described in conjunction with the appended drawing figures, wherein like reference numerals denote like elements, and.

DETAILED DESCRIPTION

Figure 1:
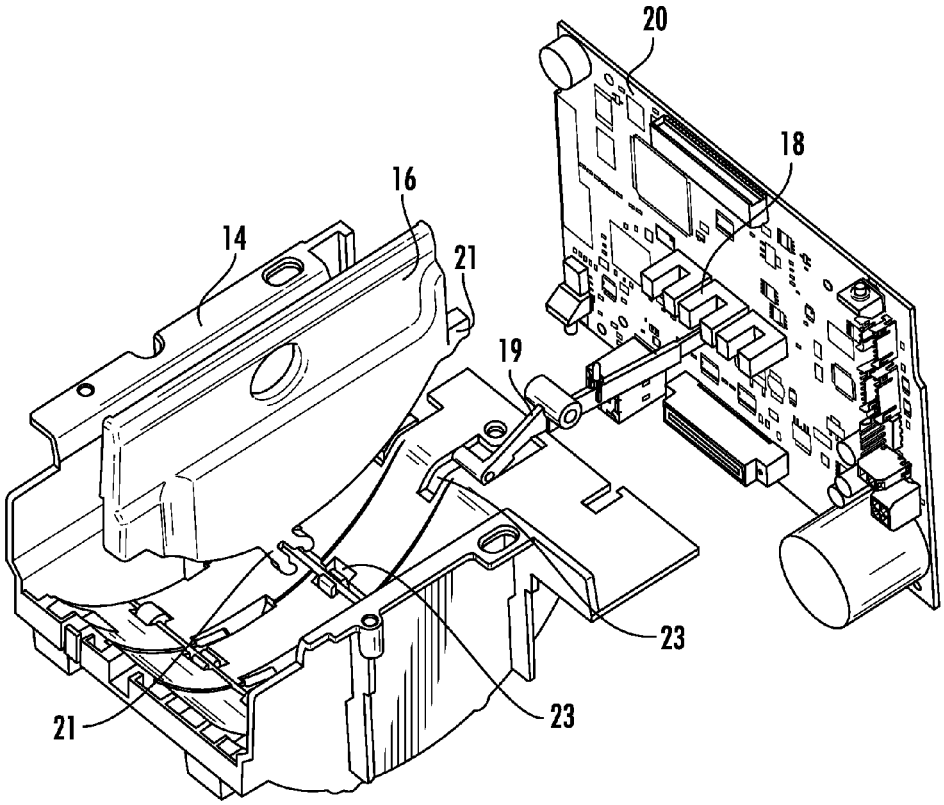
FIG. 1 shows a paper bucket, a divider, and a controller board of a printer in accordance with an example embodiment of the present invention.

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

FIGS. 1-5 show relevant components of an example embodiment of a configurable printer 10 for different paper sizes and types in accordance with the present invention. The configurable printer 10 may comprise a print mechanism 12 (shown in FIG. 5), a controller for controlling the print mechanism 12, a paper bucket 14 for receiving a first sized paper roll to be printed, a divider 16 for the paper bucket 14 for reducing a width of the paper bucket 14 to accept a second sized paper roll which is smaller than the first sized paper roll, and a bucket sensor 18 adapted to sense at least one of insertion of the divider 16 into the paper bucket 14 and removal of the divider 16 from the paper bucket 14 and to provide a paper size signal to the controller. The controller controls the print mechanism 12 in response to the paper size signal from the bucket sensor 18.

The controller may be implemented on a controller board 20 of the printer 10.

Figure 2:
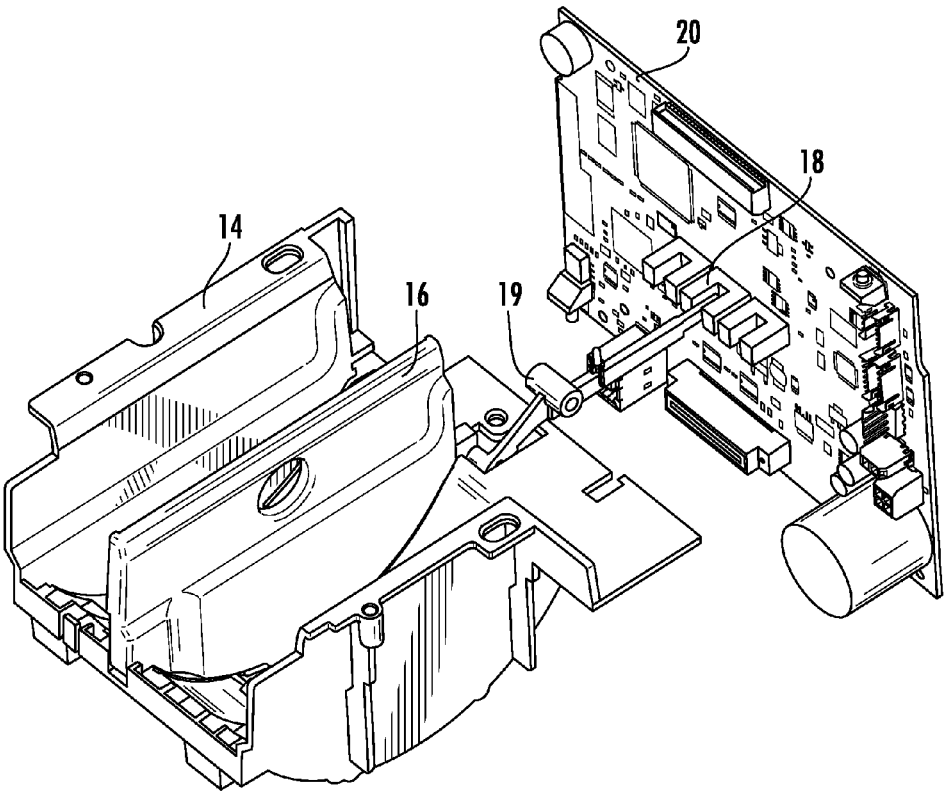
FIG. 2 shows a paper bucket with a divider inserted therein and a controller board of a printer in accordance with an example embodiment of the present invention.
Figure 3:
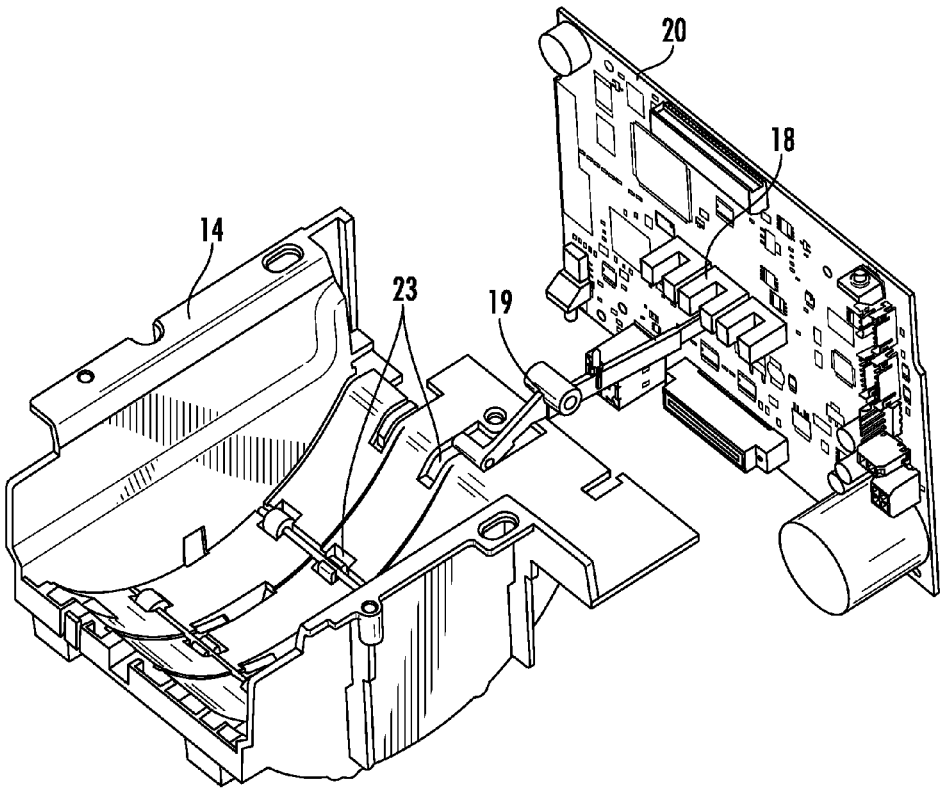
FIG. 3 shows a paper bucket and a controller board of a printer in accordance with an example embodiment of the present invention.
Figure 4:
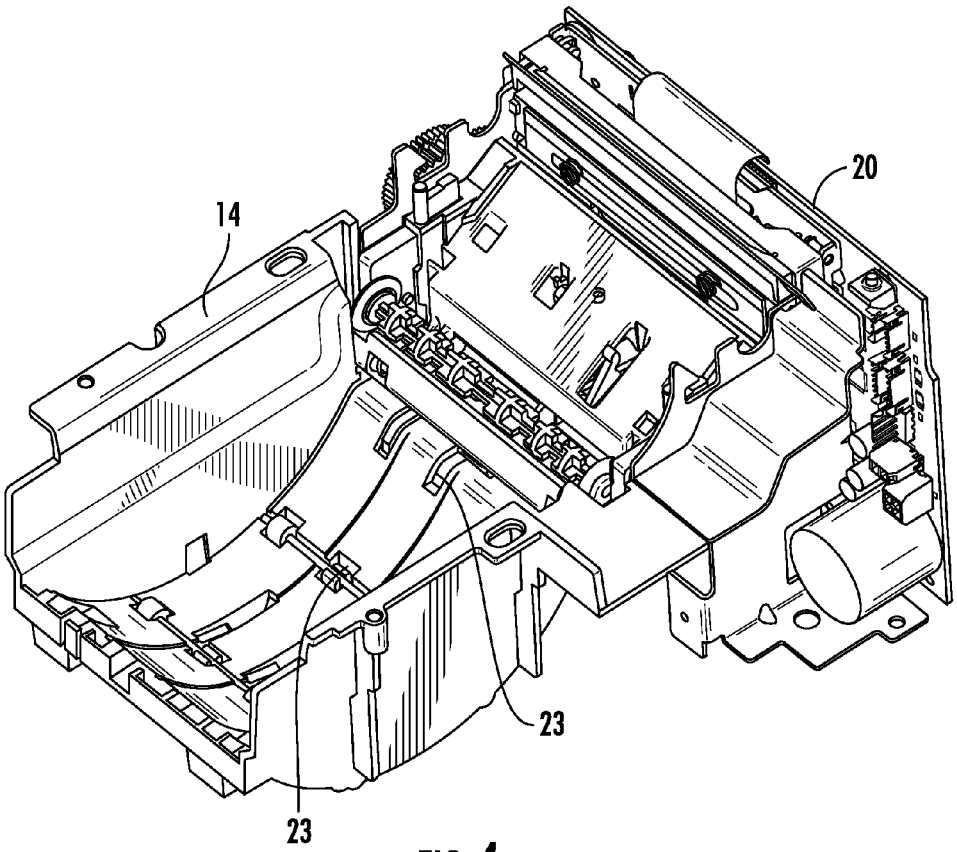
FIG. 4 shows a paper bucket and a controller board, together with printer mechanicals, of a printer in accordance with an example embodiment of the present invention
Figure 5:
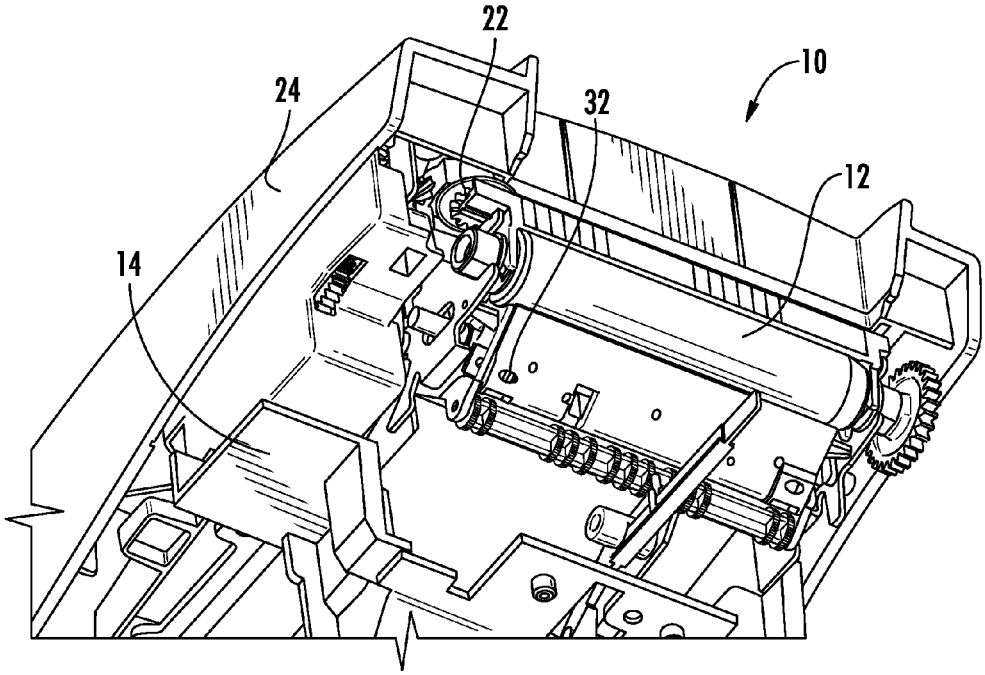
FIG. 5 shows a perspective partial view of a printer with a lower housing removed in accordance with an example embodiment of the present invention.

FIGS. 1-3 shows the paper bucket 14 and controller board 20 only for clarity, with the surrounding printer mechanicals removed. In particular, FIG. 1 shows the paper bucket 14 and the controller board 20, with the divider 16 in a position just prior to or just after removal from the paper bucket 14. FIG. 2 shows the paper bucket 14 and controller board 20 with the divider 16 inserted in position in the paper bucket 14. FIG. 3 shows the paper bucket 14 and controller board 20 with the divider 16 removed. FIG. 4 shows the paper bucket 14 and the controller board 20 together with the surrounding printer mechanicals. It should be appreciated that the paper bucket 14 and controller board 20 shown in the Figures may reside in a lower printer housing (not shown), and a cutter mechanism 22 and the print mechanism 12 may reside in a pivoting printer cover 24 that closes the lower printer housing, where the paper path for the paper roll runs between the cover 24 and the housing. FIG. 5 shows a perspective view of the printer 10 with the pivoting cover 24 in a closed position but with the lower housing portion removed for clarity.

The controller may reduce at least one of a print area and a speed of the print mechanism 12 in accordance with the paper size signal when the bucket sensor 18 senses the insertion of the divider 16 into the paper bucket 14. The controller may increase at least one of a print area and a speed of the print mechanism 12 in accordance with the paper size signal when the bucket sensor 18 senses the removal of the divider 16 from the paper bucket 14.

The configurable printer 10 may further comprise a cutter mechanism 22 for cutting the paper roll, which may be configured and controlled based on the paper size signal. The cutter mechanism 22 may comprise a rotary cutter mounted for rotation about a rotation axis and for translation across at least a portion of a width of a paper path perpendicular to the rotation axis. An example of such a configurable cutter mechanism is described in detail in a commonly-owned application entitled "Configurable Cutter Mechanism For a Printer and Method For Configuring a Cutter Mechanism For a Printer" filed on the same date as the present application, which is incorporated herein and made a part hereof by reference.

The controller may control a length of travel of the cutter mechanism 22 in response to the paper size signal from the bucket sensor 18. For example, the controller may reduce the length of travel of the cutter mechanism 22 in accordance with the paper size signal when the bucket sensor 18 senses the insertion of the divider 16 into the paper bucket 14. The controller may increase the length of travel of the cutter mechanism 22 in accordance with the paper size signal when the bucket sensor 18 senses the removal of the divider 16 from the paper bucket 14.

In addition, the cutter mechanism 22 may be configured to make partial or full cuts of the paper. For example, if a 40 mm paper roll is sensed, the controller may limit the cutter mechanism 22 to a paper path that is 39 columns long and if an 80 mm paper roll is sensed, the controller may limit the cutter mechanism 22 to a paper path that is 79 columns long, resulting in a partial cut of the paper roll (a full cut corresponding to a 40 or 80 column paper path for the 40 and 80 mm rolls, respectively). The cutter mechanism 22 may be controlled such that a full cut is completed at selected intervals (e.g., every third or fifth cut).

The controller may reduce a scale of text to be printed by the print mechanism 12 in accordance with the paper size signal when the bucket sensor 18 senses the insertion of the divider 16 into the paper bucket 14. The controller may increase a scale of text to be printed in accordance with the paper size signal when the bucket sensor 18 senses the removal of the divider 16 from the paper bucket 14. For example, when the bucket sensor 18 senses the insertion of the divider 16, the controller may slow the print mechanism 12 to approximately 8 inches per second. When the divider 16 is removed, the controller may speed the print mechanism 12 up to approximately 12 inches per second.

Figure 6:
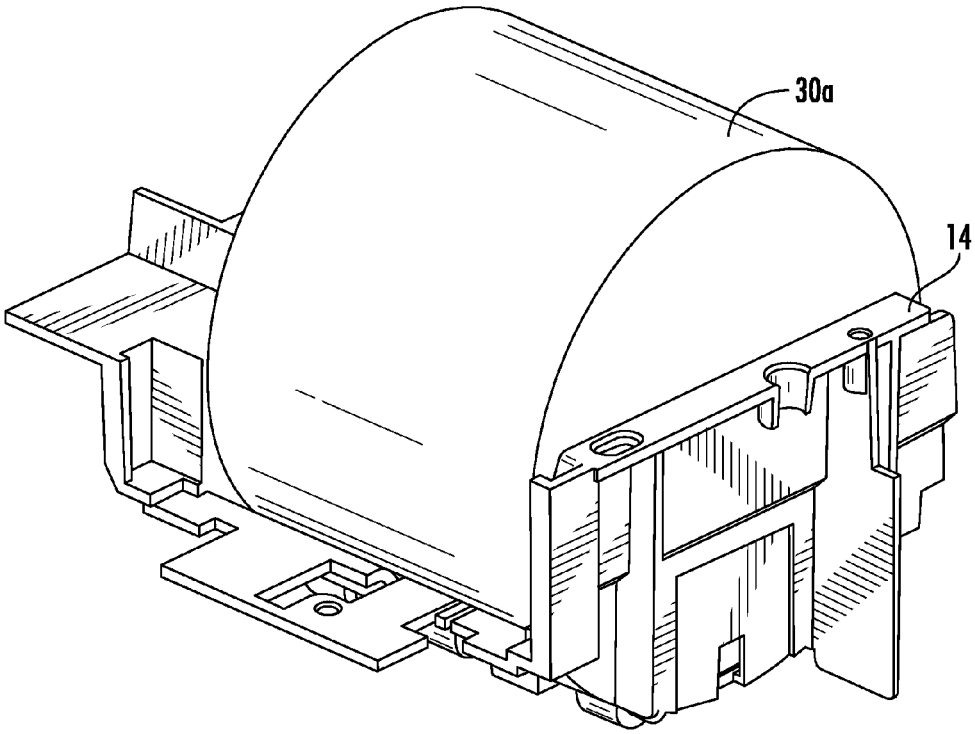
FIG. 6 shows a first sized paper roll in a paper bucket in accordance with an example embodiment of the present invention.
Figure 7:
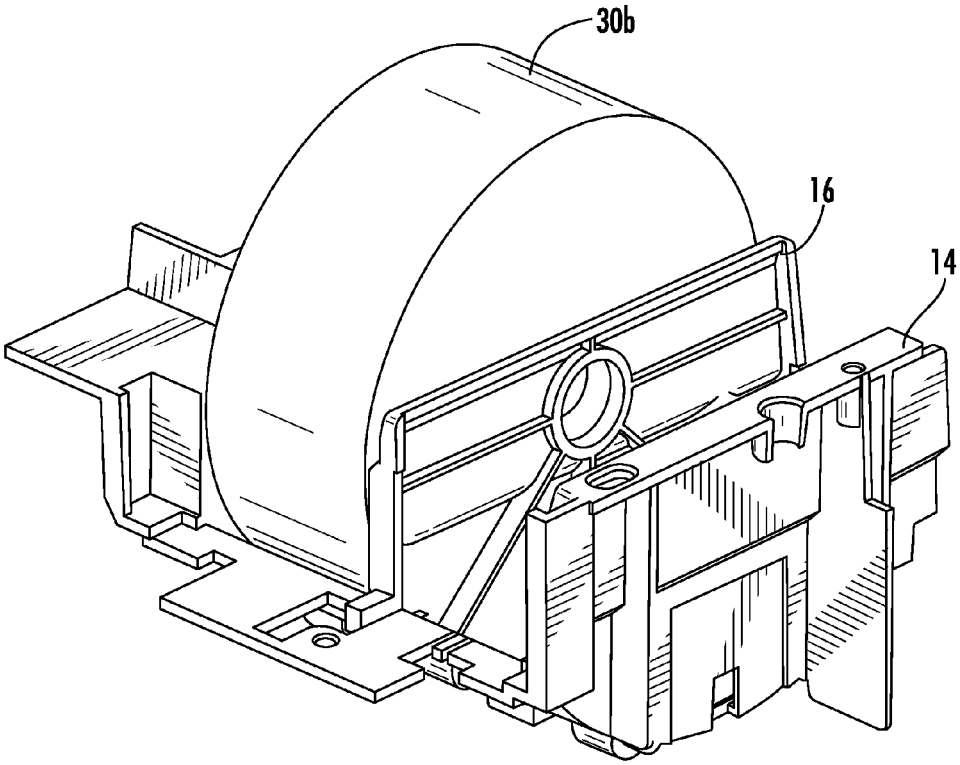
FIG. 7 shows a second sized paper roll in a paper bucket with a divider inserted in accordance with an example embodiment of the present invention.

As shown in FIG. 6, the first sized paper roll 30*a* may be, for example 80 mm wide. As shown in FIG. 7, the second sized paper roll 30*b* may be, for example, 40 mm wide. However, those skilled in the art will appreciate that the paper bucket 14 and divider 16 may be configured to accept various sizes of paper rolls. It is also conceivable that the configurable printer can be designed to accept three different sized paper rolls, e.g., by providing two separate areas for insertion of the divider 16.

Figure 12:
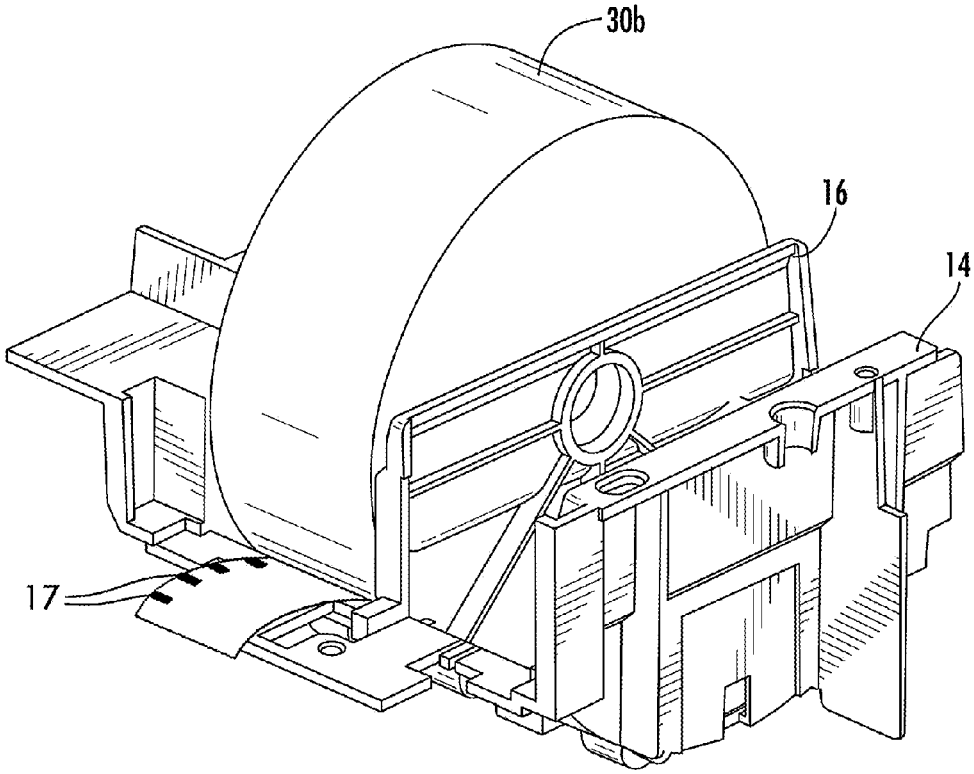
FIG. 12 shows an example embodiment of a second sized paper roll of adhesive backed label paper in a paper bucket with a divider inserted in accordance with an example embodiment of the present invention.

Label printers may use a paper roll with glue or other adhesive on one side for printing sticky labels rather than plain thermal paper rolls. Such rolls containing adhesive may include evenly spaced apart black dots or lines denoting print areas for the sticky labels. To accommodate the use of sticky label paper rolls, the configurable printer 10 may further comprise a paper sensor 32 for sensing a presence of black marks (e.g., lines or dots) on the paper roll and providing a paper type signal to the controller. The controller, in response to the paper type signal indicating the presence of black marks, may at least one of decreases a print speed of the print mechanism 12 and increases an energy of the print mechanism 12 to better print on the sticky paper roll. For example, as shown in FIG. 12, the second sized (smaller) paper roll 30b may be an adhesive backed paper roll, and the black marks 17 may denote a location of adhesive, which is positioned between the black marks 17. If no black marks 17 are sensed, the print speed may be increased (e.g., from 8 inches per second to 12 inches per second) and the print energy may be reduced.

The controller may accept signals from both the bucket sensor 18 and the paper type sensor 32. In such an embodiment, the signal from the bucket sensor 18 will set the paper size for the printer and the controller will configure the print area and length of travel of the cutter mechanism 22 in accordance therewith. The signal from the paper sensor 32 will set the paper type and the controller will configure the print speed and print energy in accordance therewith.

The bucket sensor 18 may comprise an optical sensor residing on a controller board 20 of the printer 10. A flag 19 may be provided for triggering the bucket sensor 18 upon insertion of the divider 16 into the paper bucket 14 and contacting the flag 19. One or more protrusions 21 on the divider 16 may depress the flag 19 to trigger the bucket sensor 18 to indicate the insertion of the divider 16 into the paper bucket 14 (as shown in FIG. 2).

Figure 8:
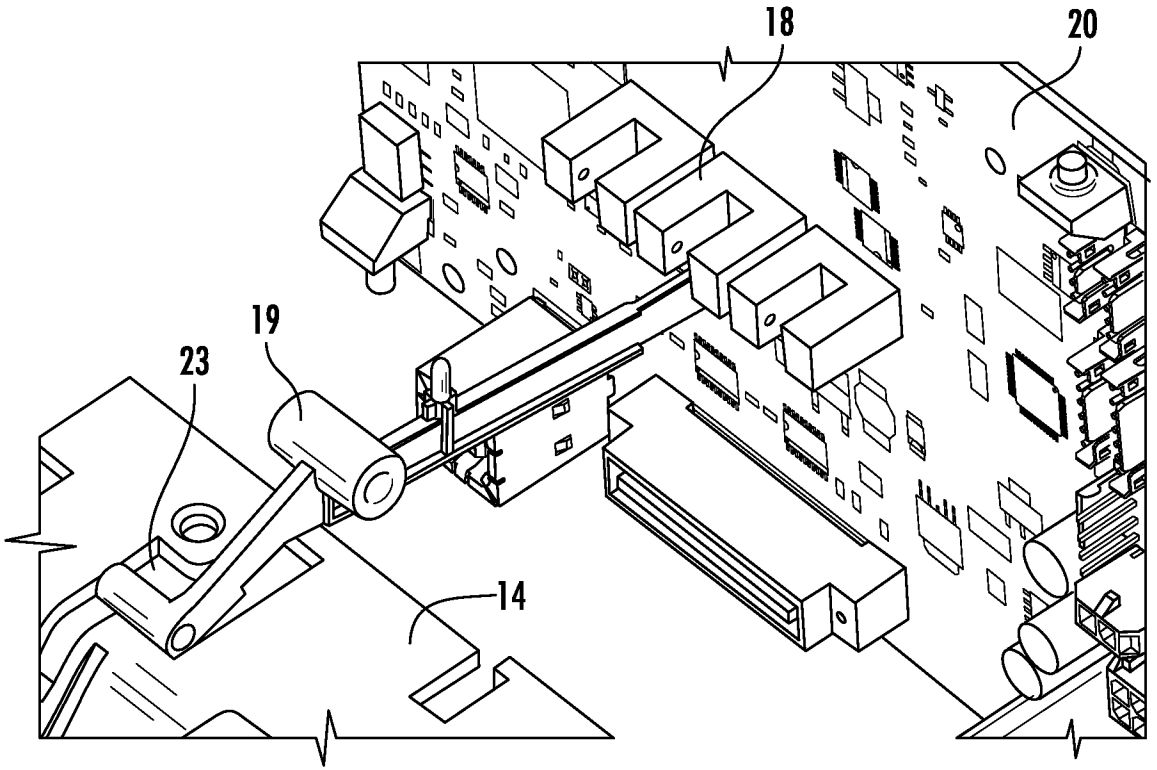
FIG. 8 shows a sensor and flag arrangement in accordance with an example embodiment of the present invention.
Figure 9:
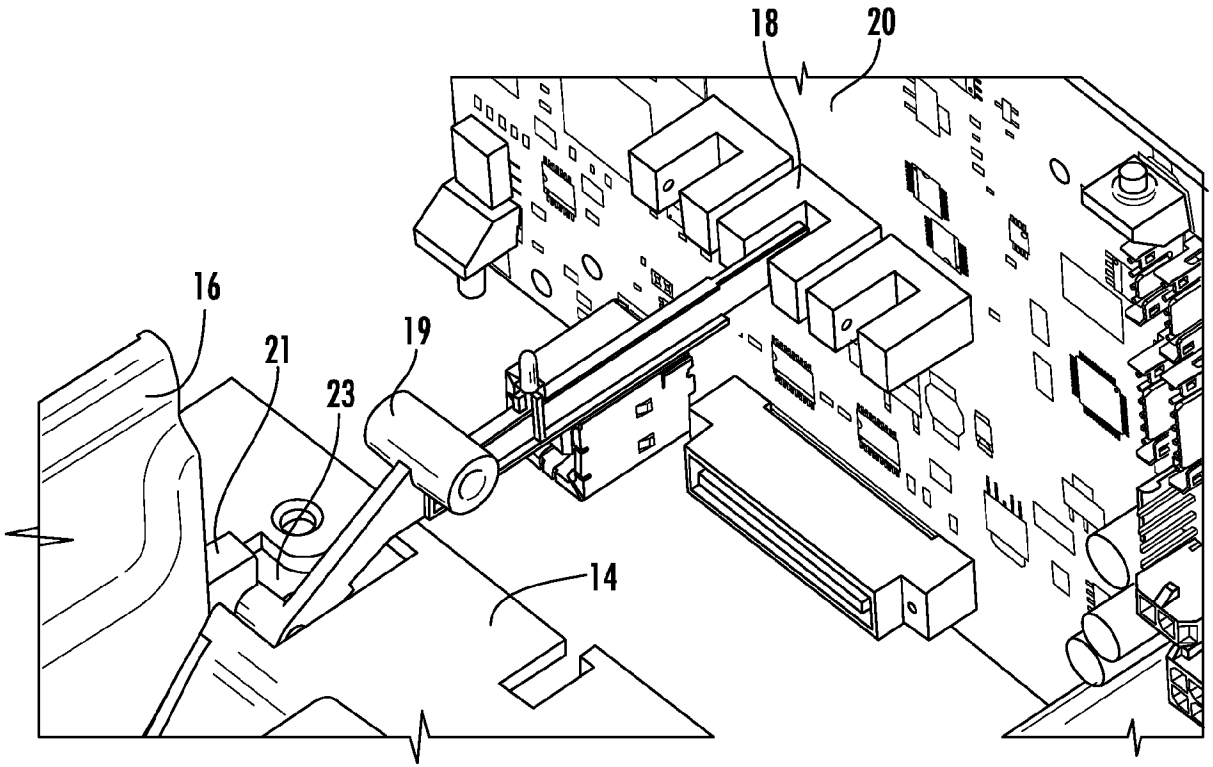
FIG. 9 shows a sensor and flag arrangement in accordance with an example embodiment of the present invention, with the flag depressed by a divider.

For example, the sensor 18 may be a slotted sensor as shown in the detailed views of FIGS. 8 and 9. One end of flag 19 may move into position between slots of the sensor 18 to trip or interrupt the sensor 18. The other end of the flag 19 may be acted on by the divider 16 when inserted into bucket 14. FIGS. 1, 3, and 8 show the divider 16 either just after removal from or just prior to insertion in the paper bucket 14. When the divider 16 is not inserted into position in the paper bucket 14, the flag 19 does not trigger the bucket sensor 18 (e.g., as can be seen in FIG. 8, one end of the flag 19 is not depressed by a corresponding portion of the divider 16 and the other end of the flag does not raise up into the slot of the slotted sensor 18), and via the paper size signal, the printer is configured for the larger sized paper roll. FIGS. 2 and 9 show the divider 16 completely inserted into the paper bucket 14 and depressing the flag 19, triggering the bucket sensor 18. In particular, the protrusion 21 of the divider 16 depresses one end of the flag 19, which raises the opposite end of the flag 19 into the slot of the slotted sensor 19, as can be seen in FIG. 9. In this position, the printer is configured to conform to the reduced width of the smaller paper roll.

Although the Figures show a flag-type bucket sensor 18, those skilled in the art will appreciate that other types of sensors may also be used to detect the presence of the divider 16, such as an optical sensor without a flag, a hall effect sensor, a mechanical switch, a magnetic switch, various configurations of the flag-type sensor, or the like. It is also possible for the divider 16 to be configured to directly trigger the slotted sensor 18.

At least one of the one or more protrusions 21 may serve to fix the divider 16 in the paper bucket 14. In particular, protrusions 21 on the divider 16 may be accommodated in depressions or openings 23 in the paper bucket 14. One or more of the protrusions 21 may be slotted and adapted to interlock or snap into a corresponding extension in an opening 23 in the paper bucket 14.

Figure 10:
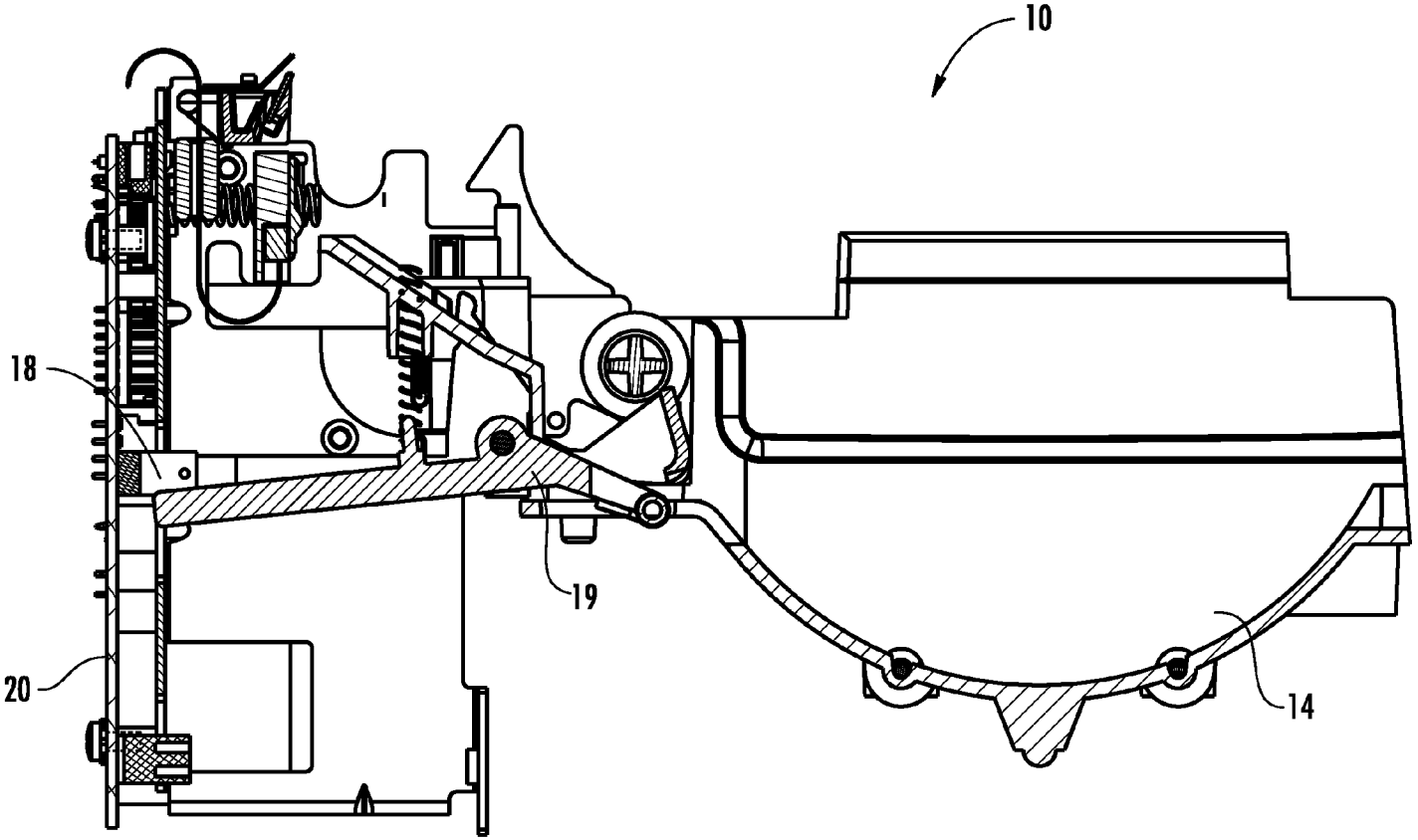
FIG. 10 shows a side sectional view of a printer without a divider present in the paper bucket, in accordance with an example embodiment of the present invention.
Figure 11:
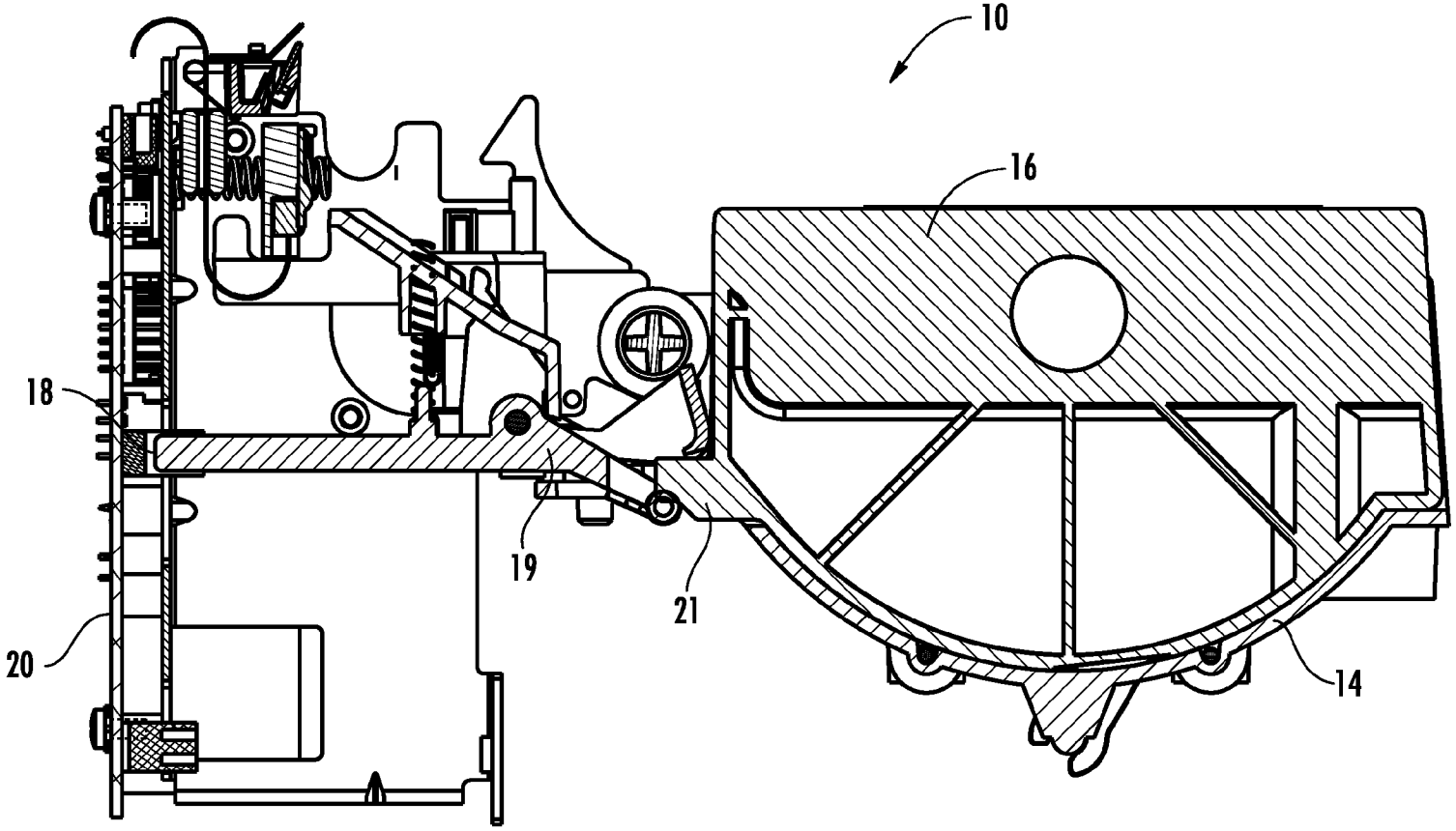
FIG. 11 shows a side sectional view of a printer with a divider inserted in the paper bucket, in accordance with an example embodiment of the present invention.

FIG. 10 shows a sectional view of the printer 10 with the divider 16 removed (i.e., configured for the first or larger sized paper roll 30*a*). FIG. 11 shows a sectional view of the printer 10 with the divider 16 inserted (i.e., configured for the second or smaller sized paper roll 30*b*).

It should now be appreciated that the present invention provides an advantageous configurable printer which can be used with different sized paper rolls, as well as corresponding methods for configuring such a printer for different sized paper rolls.

Although the invention has been described in connection with various illustrated embodiments, numerous modifications and adaptations may be made thereto without departing from the spirit and scope of the invention as set forth in the claims.

What is claimed is:

1. Configurable printer for different paper sizes and types, comprising:

a print mechanism;

a cutter mechanism for cutting paper from a paper roll;

a controller for controlling the print mechanism and the cutter;

a paper bucket for receiving a first sized paper roll to be printed;

a divider for the paper bucket for reducing a width of the paper bucket to accept a second sized paper roll which is smaller than the first sized paper roll;

one or more protrusions extending from the divider such that at least one of the one or more protrusions fix the divider in the paper bucket in a removable manner; and a bucket sensor adapted to sense at least one of insertion of the divider into the paper bucket and removal of the divider from the paper bucket and to provide a paper size signal to the controller;

a flag for triggering the bucket sensor upon insertion of the divider into the paper bucket such that at least one of the one or more protrusions extending from the divider depresses the flag;

wherein:

the controller controls a print area and a speed of the print mechanism in response to the paper size signal from the bucket sensor; and the controller controls a length of travel of the cutter mechanism in response to the paper size signal from the bucket sensor.

2. The configurable printer in accordance with claim 1, wherein the controller reduces at least one of the print area and the speed of the print mechanism in accordance with the paper size signal when the bucket sensor senses the insertion of the divider into the paper bucket.

3. The configurable printer in accordance with claim 1, wherein the controller increases at least one of the print area and the speed of the print mechanism in accordance with the paper size signal when the bucket sensor senses the removal of the divider from the paper bucket.

4. The configurable printer in accordance with claim 1, wherein the controller reduces the length of travel of the cutter mechanism in accordance with the paper size signal when the bucket sensor senses the insertion of the divider into the paper bucket.

5. The configurable printer in accordance with claim 1, wherein the controller increases the length of travel of the cutter mechanism in accordance with the paper size signal when the bucket sensor senses the removal of the divider from the paper bucket.

6. The configurable printer in accordance with claim 1, wherein the controller reduces a scale of text to be printed in accordance with the paper size signal when the bucket sensor senses the insertion of the divider into the paper bucket.

7. The configurable printer in accordance with claim 1, wherein the controller increases a scale of text to be printed in accordance with the paper size signal when the bucket sensor senses the removal of the divider from the paper bucket.

8. The configurable printer in accordance with claim 1, wherein:

the first sized paper roll is 80 mm wide; and the second sized paper roll is 40 mm wide.

9. The configurable printer in accordance with claim 1, further comprising:

a paper sensor for sensing a presence of black marks on the paper roll and providing a paper type signal to the controller;

wherein the controller, in response to the paper type signal indicating the presence of black marks, at least one of decreases a print speed of the print mechanism and increases an energy of the print mechanism.

10. The configurable printer in accordance with claim 9, wherein:

the second sized paper roll is an adhesive backed paper roll; and the black marks denote a location of adhesive, which is positioned between the black marks.

11. The configurable printer in accordance with claim 1, wherein:

the bucket sensor comprises an optical sensor residing on a controller board of the printer.

12. A method for configuring a printer for different paper sizes and types, comprising:

providing a divider for a paper bucket for reducing a width of the paper bucket;

providing one or more protrusions extending from the divider such that at least one of the one or more protrusions fix the divider in the paper bucket in a removable manner, sensing at least one of insertion of the divider into the paper bucket and removal of the divider from the paper bucket via a bucket sensor;

providing a flag for triggering the bucket sensor upon insertion of the divider into the paper bucket such that at least one of the one or more protrusions extending from the divider depresses the flag; and providing a paper size signal from the bucket sensor for use in controlling a print mechanism and a cutter mechanism of the printer;

wherein:

a print area and a speed of the print mechanism are controlled in response to the paper size signal; and a length of travel of the cutter mechanism is controlled in response to the paper size signal.

13. The method in accordance with claim 12, wherein:

the paper bucket is adapted for receiving a first sized paper roll without the divider and to receive a second sized paper roll with the divider, the second sized paper roll being smaller than the first sized paper roll.

14. The method in accordance with claim 13, wherein:

the first sized paper roll is 80 mm wide; and the second sized paper roll is 40 mm wide.

15. The method in accordance with claim 12, the controlling comprises reducing at least one of the print area and the speed of the print mechanism in accordance with the paper size signal when the bucket sensor senses the insertion of the divider into the paper bucket.

16. The method in accordance with claim 12, the controlling comprises increasing at least one of the print area and the speed of the print mechanism in accordance with the paper size signal when the bucket sensor senses the removal of the divider from the paper bucket.

17. The method in accordance with claim 12, wherein the controlling comprises reducing the length of travel of the cutter mechanism in accordance with the paper size signal when the bucket sensor senses the insertion of the divider into the paper bucket.

18. The method in accordance with claim 12, wherein the controlling comprises increasing the length of travel of the cutter mechanism in accordance with the paper size signal when the bucket sensor senses the removal of the divider from the paper bucket.

19. The method in accordance with claim 12, wherein the controlling comprises reducing a scale of text to be printed in accordance with the paper size signal when the bucket sensor senses the insertion of the divider into the paper bucket.

20. The method in accordance with claim 12, wherein the controlling comprises increasing a scale of text to be printed in accordance with the paper size signal when the bucket sensor senses the removal of the divider from the paper bucket.

21. The method in accordance with claim 12, further comprising:

sensing a presence of black marks on the paper roll and providing a paper type signal to a controller;

at least one of decreasing a print speed of the print mechanism and increasing an energy of the print mechanism upon sensing the presence of the black marks.

22. The method in accordance with 21, wherein:

the black marks denote an adhesive backed paper roll with adhesive positioned between the black marks.

23. The method in accordance with claim 12, wherein:

the bucket sensor comprises an optical sensor residing on a controller board of the printer.

* * * * *

UNITED STATES PATENT AND TRADEMARK OFFICE

CERTIFICATE OF CORRECTION

PATENT NO. : 8,950,957 B2
APPLICATION NO. : 13/419502
DATED : February 10, 2015
INVENTOR(S) : Supron et al.

It is certified that error appears in the above-identified patent and that said Letters Patent is hereby corrected as shown below:

IN THE CLAIMS:

Column 8, line 55, claim 22: "The method in accordance with 21, wherein:" should read -- The method in accordance with claim 21, wherein: --

Signed and Sealed this
Tenth Day of November, 2015

Michelle K. Lee

Michelle K. Lee
*Director of the United States Patent and Trademark Office*